United States Patent [19]

Hertel et al.

[11] Patent Number: 4,736,936

[45] Date of Patent: Apr. 12, 1988

[54] HANKY DELIVERY SYSTEM

[75] Inventors: James E. Hertel, Green Bay; Steven G. Gould, Denmark, both of Wis.

[73] Assignee: Paper Converting Machine Company, Green Bay, Wis.

[21] Appl. No.: 4,052

[22] Filed: Jan. 16, 1987

[51] Int. Cl.[4] ..... B65H 37/06

[52] U.S. Cl. ..... 270/58; 271/187; 271/315

[58] Field of Search ..... 270/32, 41, 58; 271/315, 187

[56] References Cited

U.S. PATENT DOCUMENTS 2,850,281 9/1958 Heimlicher ..... 271/187
3,459,421 8/1969 Motter .
4,522,387 6/1985 Leuthold .
4,595,193 6/1986 Nakamura .

FOREIGN PATENT DOCUMENTS 702650 2/1941 Fed. Rep. of Germany ..... 271/315
355162 6/1961 Switzerland .

*Primary Examiner*—Richard A. Schacher
*Attorney, Agent, or Firm*—Tilton, Fallon, Lungmus & Chestnut

[57] ABSTRACT

A hanky delivery system including a folding mechanism slotted star wheel and collector/divider of the movable type wherein the collector divider is a chain loop having an upper turning radius positioned within the periphery of the slotted wheel and sized smaller than the bottom turning radius for the chain loop.

6 Claims, 4 Drawing Sheets

HANKY DELIVERY SYSTEM

BACKGROUND AND SUMMARY OF INVENTION

This invention relates to a hanky delivery system and, more particularly, to a system which delivers folded paper hankies and which features a novel and advantageous stacker.

Currently available machinery for delivering stacks of disposable hankies—embody slotted wheels, i.e., wheels with backwardly directed spiral slots. Such slotted wheels have been used for many years in many applications—see, for example U.S. Pat. Nos. 3,459,421; 4,522,387 and 4,595,193.

The currently available machinery makes use of stationary collector which not only makes the machinery more complicated but more expensive. Although moving collectors have been known—see Swiss Pat. No. 355,163, the principle has not been applied to hanky delivering machinery.

According to the invention, a moving collector is advantageously employed through the use of a specific chain loop where the upper turning radius is smaller than the lower turning radius and positioned within the perimeter defined by the inner ends of the spiral slots of the slotted wheel and where the stack developing path of the collector is defined geometrically.

Other features and advantages of the invention may be seen in the details of the ensuing specification.

The invention is described in conjunction with the accompanying drawing, in which FIG. 1 is a fragmentary side elevational view, partially schematic, of the stack developing portion of the machine;

DETAILED DESCRIPTION

Figure 1:
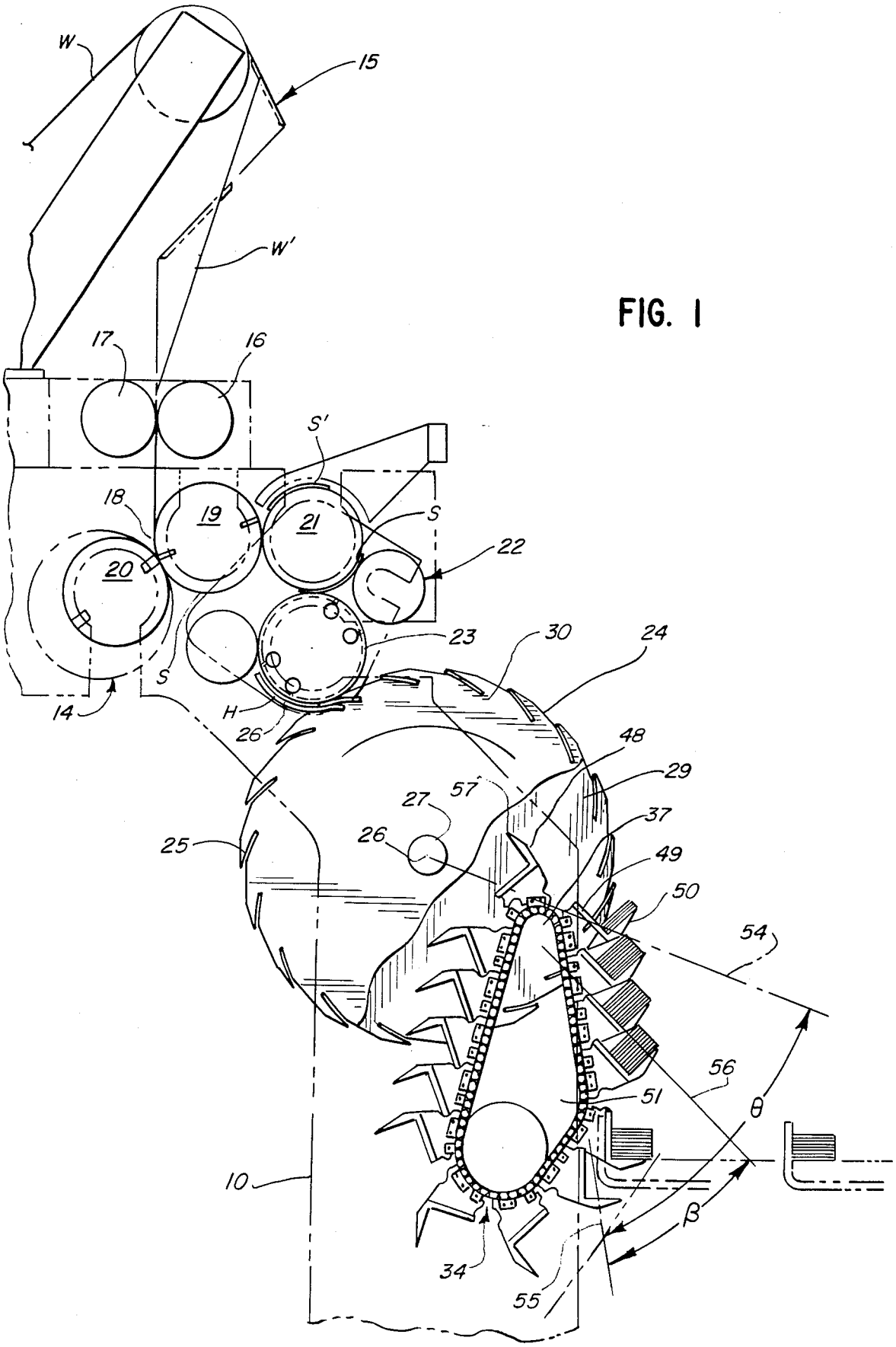

In the illustration given and with reference first to FIG. 1, the numeral 10 designates generally the machine frame. In conventional practice, the frame is made up of a pair of side frames 11 and 12 (see FIG. 3) suitably interconnected and rigidified by means of cross members as at 13.

Referring again to FIG. 1, a folding mechanism generally designated 14 is seen in the upper left hand portion. A web W enters the machine at the upper left and proceeds along a generally vertical first path, being engaged by a Z fold plate 15 which can provide longitudinally extending fold or folds in the web W. Thereafter, the web—now designated W'—passes between pull rolls 16 and 17. It will be appreciated that provided as part of the equipment but not shown herein for ease of understanding is an unwind mechanism which normally provides a wide web which is slit into a number of ribbons. Again, for ease of presentation, we show the mechanism needed for only one of the web ribbons. The pull rolls are operative to maintain the tension of the web being unwound from the unwind mechanism (not shown).

The web W' after being advanced between the pull rolls 16, 17 enters the nip 18 provided by rolls making up a cutoff mechanism. These rolls are designated 19 and 20 and may provide either a pinch or a shear cut as desired. The roll 19 is a vacuum equipped roll and is conventionally known as a carrier roll so as to conduct the now severed web segment S partially around its periphery to a further vacuum equipped roll 21 which serves as a transfer roll. This roll can serve, as illustrated, as a folding roll so as to transversely fold the segment S on itself to provide the configuration designated S' in positions both above and below the center of the transfer roll 21. Optionally provided in the path of travel of the folded segments S' is a crimping roll 22 to introduce a line of incipient folding so as to achieve a further transverse fold—this being developed by the folding roll 23. The folding roll 23 again is a vacuum equipped roll and resulting from its action is a twice transversely folded web designated H.

The foregoing folding mechanism 14 is essentially conventional although in the past it has been located remote from the stacker. According to our invention, we position the folding mechanism 14 and more particularly, the last folding roll 23, immediately adjacent the slotted wheel 24 and assist in introducing the hankies H into the spiral slots 25 by means of an arcuate guide plate 26 also mounted on the frame 10.

Figure 3:
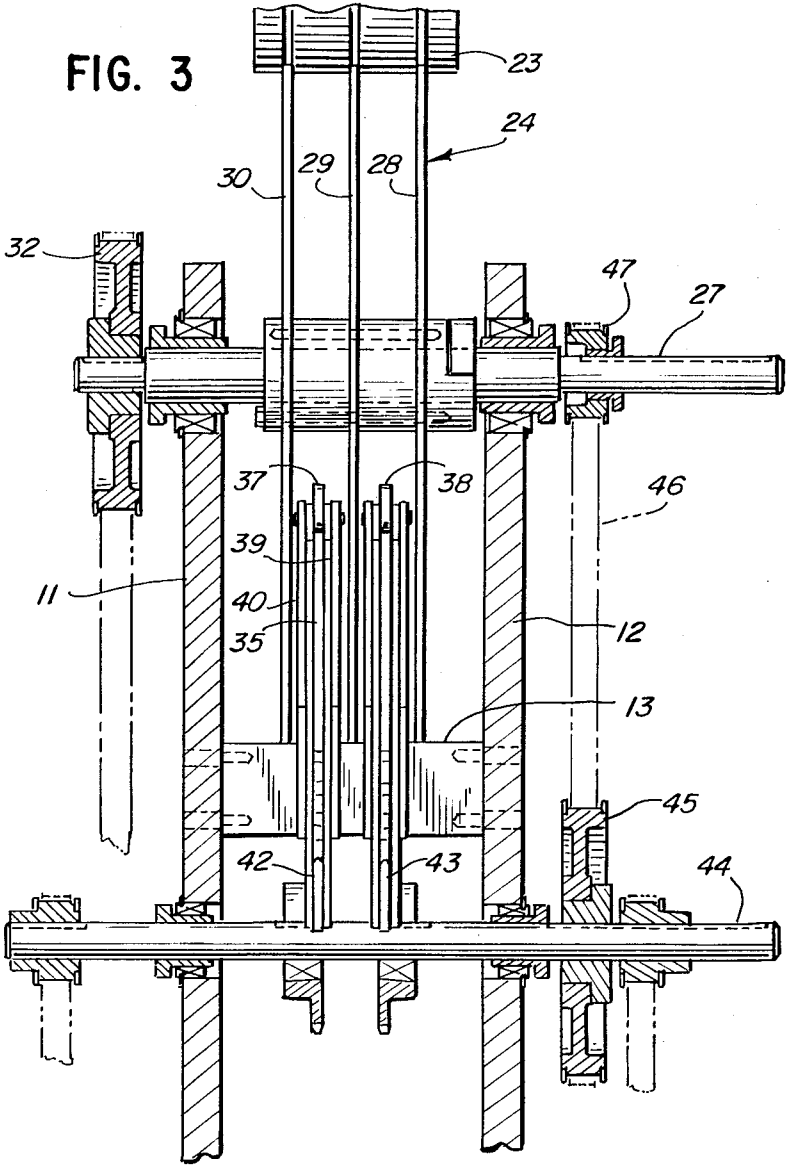
FIG. 3 is an end elevational view of the structure of FIG. 2.

The slotted wheel 24 receives the hankies sequentially in the slots 25 to advance them through a generally arcuate second path—this by rotating around a horizontal axis 26 and, more particularly, being carried by a shaft 27 (see also the upper right portion of FIG. 3).

Figure 2:
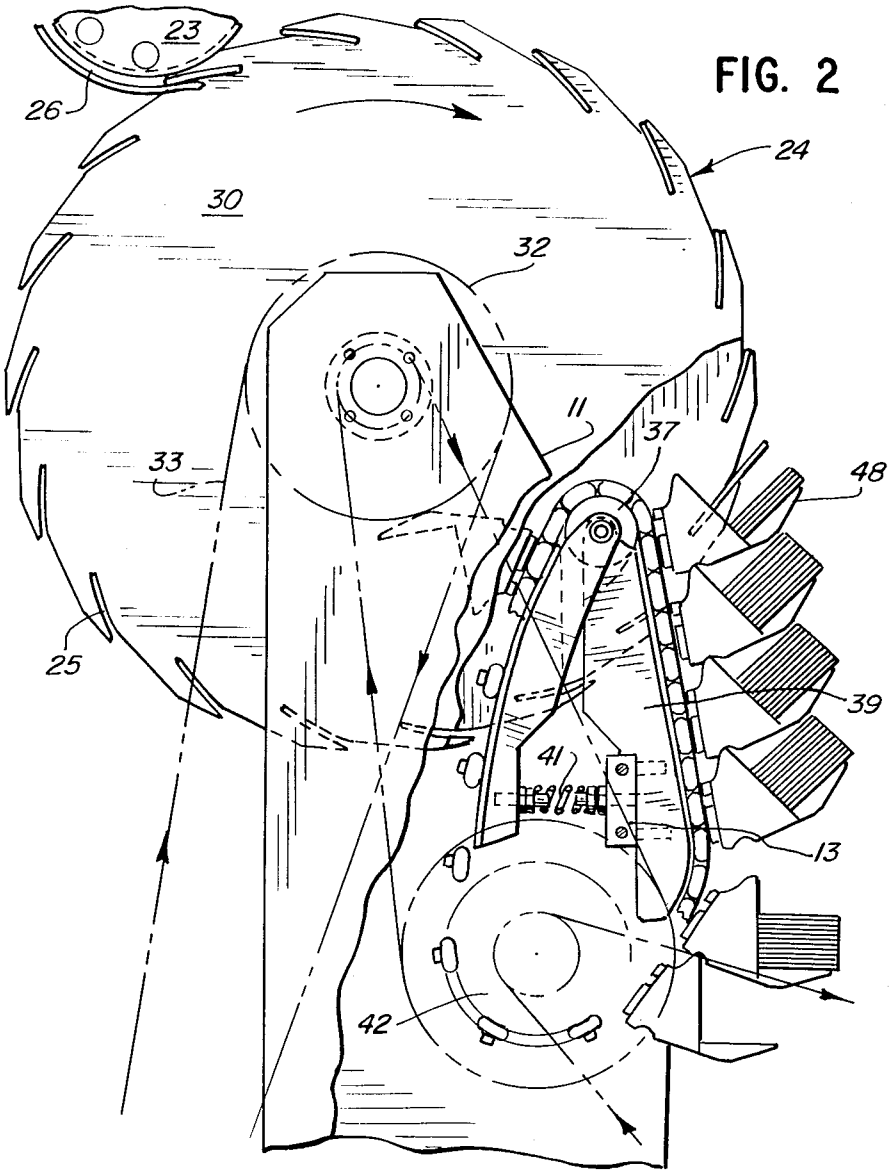
FIG. 2 is a view similar to FIG. 1 but in larger scale and showing additional operating elements.

In FIG. 3, it will be noted that the slotted wheel 24 is made up, in the illustration given, of three plates 28, 29 and 30 spaced axially along the shaft 27. These plates ride in grooves as seen in the upper extreme part of FIG. 3 in the folding roll 23. The plates 28–30 are rigidly mounted on a hub 31 affixed to the shaft 27. The shaft 27 in turn is equipped with a sprocket 32 (see also the central upper part of FIG. 2) which is chain driven as at 33 from a suitable power source (not shown).

Collector/Divider

Referring again to FIG. 1, the numeral 34 designates generally the mechanism for collecting the hankies into stacks and dividing the hankies into predetermined numbers within each stack. The mechanism 34 includes a pair of chain loops 35 and 36—see the central portion of FIG. 3. Each chain loop 35, 36 is entrained about an idling wheel as at 37 relative to the chain loop 35 and 38 relative to the chain loop 36. Each upper wheel 37 or 38, as the case may be is rigidly supported by a pair of arms as at 39 and 40 in FIG. 3. The arm 39 is rigidly connected to the frame through the cross member 13 and the arm 40 is resiliently connected to the arm 39 by means of the linkage 41. The arms 39 and 40 also provide a track or guide for the travel of the chain loop 35. Similar arms (unnumbered) are provided for the chain loop 36.

The lower end of the chain loop 35 is defined by the sprocket 42 and the lower end of the chain loop 35 defined by the sprocket 43—see FIG. 3. These sprockets are fixed to another cross shaft 44—still referring to FIG. 3—which is driven by a chain and sprocket system including the driven sprocket 45 on the shaft 44, the chain 46 and the drive sprocket 47 which is keyed to the shaft 27. Each chain loop thus is positioned between a pair of adjacent plates—the chain loop 35 between the plates 29 and 30 and the chain loop 36 between the plates 28 and 29. Each of the chain loops is equipped with an L-shaped bucket as at 48 which is limited in width so as to pass between the adjacent plates 28 and 29 or 29, 30, as the case may be. In some instances, we have fount it advantageous to employ only two plates as at 28 and 29 and thus with a single chain loop 35.

Operation of Collector/Divider

As the hankies H enter the spiral slots 25 within the slotted wheel 24, they are carried in a clockwise fashion (as indicated in FIG. 1) to a point where they intersect the upstanding arm or stripper part 49 of the L-shaped bucket 48. This causes stripping or collecting of each hanky H sequentially from its receiving slot 25 and depositing on the base or stack supporting part 50 of the L-shaped bucket 48. The buckets 48 are moving in synchronism with the chain loop 35 which in turn is traveling at about 1/10 of the speed of the slotted wheel 24. This is developed by the sprocket and chain system 45–47 seen in the extreme right hand portion of FIG. 3.

As a bucket 48 passes downwardly along a generally vertical third path and at a time near the completion of the predetermined number of hankies in a stack, a subsequent bucket 48 moves rapidly in the space between adjacent slots 25 to serve as a collector for the next stack—thereby dividing one stack from another.

To achieve this movement and thereby develop a high speed, we locate the center of the idling wheel 37 within the circle defined by the inner ends of the slotted wheel slots 25.

Output Conveyor

Figure 4:
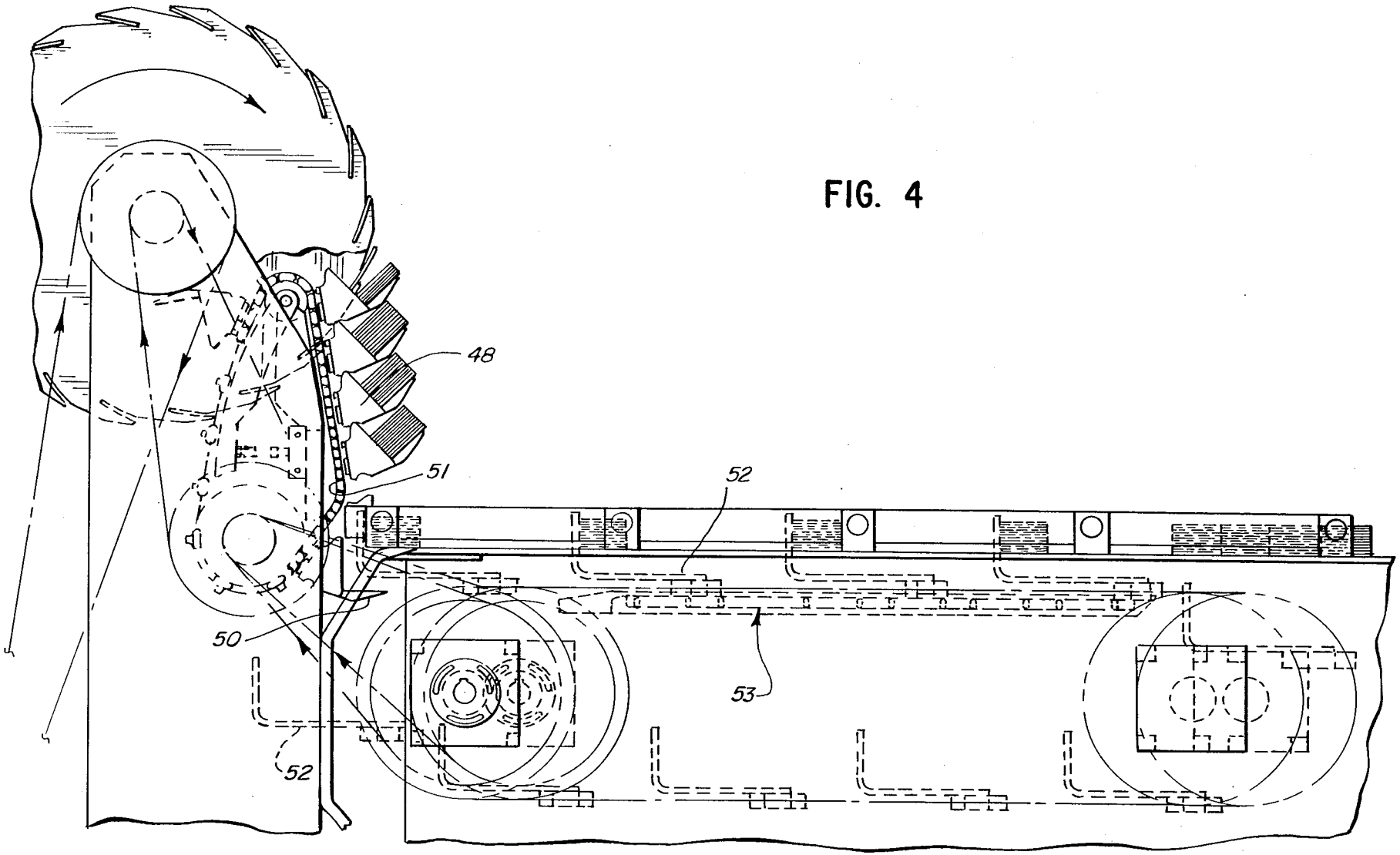
FIG. 4 is another fragmentary side elevational view showing not only the stacking portion of the machine but also the output conveyor.
Figure 5:
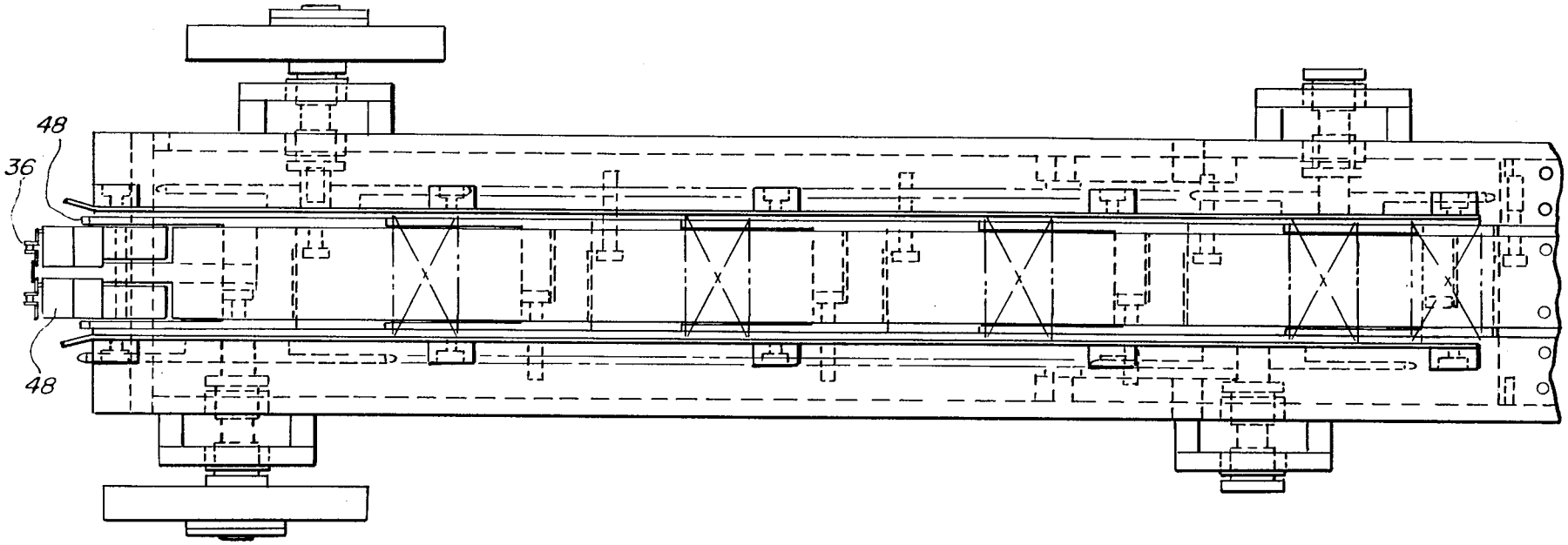
FIG. 5 is a top plan view of the conveyor of FIG. 4.

Referring now to FIGS. 4 and 5, it will be seen that the buckets 48 pass around an intermediate radius as at 51 defined by the arm 39. This disposes each bucket so that its bottom leg 50 is horizontal and permits the withdrawal of a completed stack of hankies by means of L-shaped arms 52 carried by a conveyor generally designated 53. The conveyor 53 supports three transversely spaced apart arms 52 which are positioned between and athwart the two buckets 48 for each slotted wheel 24 for transporting the stacks along a generally horizontal fourth path.

We have discovered that an important factor in the arrangement of the elements in our invention is the relationship of the third path to a particular point in the stack-developing cycle. This point is where the middle hanky of a developing stack contacts the stripper part 49. More especially, we find it advantageous to provide an angle of $\theta$ having a certain cosine value—see the lower right hand portion of FIG. 1—and which is defined by the lines 54 and 55. The line 54 joins the axis 26 to the point in the cycle where the middle hanky of a stack contacts the stripper part 49. The line 55 is along the third path, viz., the stack-filled bucket path. The cosine value is a function of the hanky thickness and chain advance per hanky and is represented by the expression:

$$\theta = \cos^{-1}(t/x)$$

where t is the thickness and x is the chain advance. It will be appreciated that this is an approximation—that a variation therefrom may stem from particular design parameters. Such can be appreciated from the following example.

EXAMPLE

In an operative embodiment of the invention, the diameter of the slotted wheel 24 was 20" and, as shown, was equipped with 18 arcuate slots. Some variation in the arcuity of the slots is possible depending upon the character of the hanky being processed. The illustrated arcuity is advantageous for a hanky having a folded thickness of approximately $\frac{1}{8}$" and the number of slots along with the remaining geometry was advantageous for a chain advance of $\frac{1}{4}$" per hanky for the development of 10 hankies per stack.

Additionally, a bucket angle $\beta$ was selected at about 30° so that the stack supporting part 50 of the L-shaped bucket 48 is approximately parallel to the hanky being stripped from the slotted wheel assembly 24. The angle $\beta$ is seen in the lower right hand portion of FIG. 1 to be defined by the lines 55 and 56—line 55 being the third path as previously referred to. Line 56 is the line passing through the full bucket stripper part surface 49. The direction of the chain path from intermediate radium 51 results in the bucket stack supporting part 50 being approximately parallel to the fourth path provided by the conveyor 53 when the stack is stripped from the bucket 48 by the L shaped stripper arms 52.

As mentioned previously, we have utilized another dimensional relationship in order to achieve advantageous operation. The value of cos $\theta$ was initially calculated to be 0.5 based upon a hanky thickness of $\frac{1}{8}$" and a chain advance per hanky of $\frac{1}{4}$". The angle whose cosine is 0.5 is 60°. This was adjusted to achieved optimum operation in the mechanism constructed to 62°.

Lastly, a radius of 1" was selected for the upper wheel 37 to provide movement of the tip 57 of the L-shaped bucket 48 to pass between the tenth hanky of a completed stack and the first hanky of a next stack without the stack supporting part 50 contacting either of these two hankies—thereby providing positive stack separation.

While in the foregoing specification a detailed description of an embodiment has been put down for the sake of illustration, many variations in the details hereingiven may be made by those skilled in the art without departing from the spirit and scope of the invention.

We claim:

1. Apparatus for developing hanky stacks, comprising a frame providing a generally vertical first path for web and hankies developed therefrom, means in said first path longitudinally and transversely folding said web to provide a sequence of hankies, a rotatable slotted wheel journaled about an axis in said frame with said slots intersecting said first path for serially receiving said sequence of hankies and moving said hankies through an arcuate second path, first means for removing said hankies in stacks from said slotted wheel and advancing the same through a generally vertical third path, and second means for removing said hanky stacks from said third path and along a generally horizontal fourth path, said first removing means including a chain loop equipped with a plurality of equally spaced apart generally L-shaped buckets each having a base part for supporting a stack and terminating in a tip facing outwardly of said loop and a stripper part for engaging a hanky in one of said slots, said loop partially overlapping the periphery of said slotted wheel and having upper, intermediate and lower turning radii, the center of said upper turning radius being located within a circle defined by the inner ends of the wheel slots, said intermediate turning radius being located at the intersection of said third and fourth paths, said third path being related to a construction line by an approximate angle $\theta$ where $$\theta = \cos^{-1}(t/x),$$

t being the hanky thickness and x being the chain advance per hanky, both t and x being in consistent units, said construction line being a line from said axis to the point where the middle hanky of a developing stack contacts said stripper part.

2. The apparatus of claim 1 in which said folding means is positioned immediately adjacent said slotted wheel.

3. The apparatus of claim 1 in which said lower turning radius is greater than said upper turning radius.

4. The apparatus of claim 1 in which said intermediate turning radius is the largest.

5. The apparatus of claim 1 in which said slotted wheel includes at least two spaced apart slotted plates with a chain loop positioned therebetween.

6. The apparatus of claim 1 in which said slotted wheel includes three spaced apart parallel slotted plates, chain loop being positioned between each pair of plates.

* * * * *